US007335145B2

(12) United States Patent
Webber

(10) Patent No.: US 7,335,145 B2
(45) Date of Patent: Feb. 26, 2008

(54) FOLDABLE EXERCISE BENCH

(76) Inventor: Randall T. Webber, 1265 Park Row, La Jolla, CA (US) 92037

( * ) Notice: Subject to any disclaimer, the term of this patent is extended or adjusted under 35 U.S.C. 154(b) by 312 days.

(21) Appl. No.: 11/003,719

(22) Filed: Dec. 3, 2004

(65) Prior Publication Data

US 2006/0122045 A1 Jun. 8, 2006

(51) Int. Cl.
*A63B 26/00* (2006.01)

(52) U.S. Cl. ..... 482/142; 482/104

(58) Field of Classification Search ..... 482/142; D21/676, 686, 690, 95–100
See application file for complete search history.

(56) References Cited

U.S. PATENT DOCUMENTS

| | | | | |
|---|---|---|---|---|
| 1,350,857 | A | 8/1920 | De Cano | |
| D314,026 | S | 1/1991 | Jennings | |
| 5,353,533 | A | 10/1994 | Meade | |
| D361,808 | S | 8/1995 | Yeh | |
| 5,462,510 | A | 10/1995 | Ish, III | |
| D366,917 | S | 2/1996 | Clem | |
| 5,637,059 | A | 6/1997 | Dalebout | |
| D399,543 | S | 10/1998 | Stevens | |
| 5,921,897 | A | 7/1999 | Stevens | |
| 5,993,360 | A | 11/1999 | Stevens | |
| D425,153 | S | 5/2000 | Grider | |
| 6,264,586 | B1 | 7/2001 | Webber | |
| 6,287,243 | B1 * | 9/2001 | Isom et al. | 482/142 |
| D455,803 | S | 4/2002 | Webber | |
| 6,564,406 | B2 * | 5/2003 | VanSteenburg et al. | 5/621 |
| 6,605,023 | B1 | 8/2003 | Mobley | |
| 6,645,130 | B2 | 11/2003 | Webber | |
| 2003/0134730 | A1 | 7/2003 | Deola | |
| 2005/0143233 | A1 | 6/2005 | Shifferaw | |
| 2005/0197238 | A1 * | 9/2005 | Parker | 482/142 |
| 2005/0266972 | A1 * | 12/2005 | Shifferaw | 482/142 |
| 2006/0035772 | A1 * | 2/2006 | Golesh et al. | 482/142 |

OTHER PUBLICATIONS

Figs. 16-17, Hoist Fitness Systems CF-2165A Assembly bench and Owners Manual, 2001.*
Kettler Universal Banch.
Fig. 12 Gym 80, Basics Brochure, date unknown.
Figs. 13-15 Power Block Online Catalog, www.powerblock.com; earliest date unknown.
Figs. 16-17 Hoist Fitness Systems CF-2165A Assembly, Hoist Fitness Brochure and Owner's Manual, 2001.
Figs. 18-23 Photographs of Fittec Total Body Workout Bench, 2001.

* cited by examiner

*Primary Examiner*—Lori Amerson
(74) *Attorney, Agent, or Firm*—Procopio, Cory, Hargreaves and Savitch LLP

(57) ABSTRACT

A foldable exercise bench has a base which engages the ground at one end and a back support pivotally mounted on the base for movement between a folded position flat against the support base and a plurality of different inclined exercise positions. A front leg pivoted to the support base engages the ground in a deployed position to support the forward end of the base in a position raised above the ground and is folded flat against the support base for storage. A support link pivoted to the back support has an end for engaging a selected one of a series of spaced retaining formations on the support base to hold the back support at a selected inclined orientation. The back support, support link and retaining formations are designed to nest together in the folded position to provide a compact storage arrangement.

34 Claims, 9 Drawing Sheets

FOLDABLE EXERCISE BENCH

BACKGROUND OF THE INVENTION

The present invention relates generally to exercise benches used for support when performing weightlifting or other resistance-type exercises, and is particularly concerned with a foldable, multi-position exercise bench which can be folded up for storage or for carrying from one location to another.

Multiple position exercise benches are commonly known in the field as FID benches (flat-incline-decline), referring to the different possible bench positions. The FID bench has been a staple in the fitness industry for many years. Some FID benches may be folded for storage purposes while others do not have the ability to fold. U.S. Pat. No. 6,645,130 of Webber describes an adjustable exercise bench which can be folded into an upright orientation for storage. Some foldable benches are still fairly bulky and difficult to carry when folded, and have parts which protrude in the folded position, requiring more storage space.

SUMMARY OF THE INVENTION

It is an object of the present invention to provide a new and improved foldable, multi-position exercise bench.

According to one aspect of the present invention, a foldable exercise bench is provided which comprises a support base having a first end for engaging the ground and a second end, a back support pivotally mounted on the support base at a location between the ends for movement between a folded position flat against the support base and a plurality of adjusted, inclined positions relative to the support base, a seat pad mounted on the support base in front of the back support, and a front support leg having a first end pivotally secured to the support base and a second end for engaging the ground in a deployed position to support the second end of the support base in a position raised above the ground, the front support leg being movable between a deployed position engaging the ground and a folded position folded flat against the support base, the front support leg having a front face and a rear face, and an integrated foot rest on the support leg located in line with the support leg and not protruding forwardly or rearwardly from the front or rear face of the support leg.

Since the foldable front support leg is equipped with an integrated, non-protruding foot rest, it can be folded completely flat against the support base with no space required between the support base and support leg, and nothing protruding outwardly from the support leg, requiring less storage space.

The back support is also designed to fold flat against the upper side of the support base in the folded position. In an exemplary embodiment of the invention, the back support has a rear face and a back supporting link is pivoted at an upper end to the rear face of the back support. The support base has a series of spaced, upwardly directed teeth or retaining formations defining a series of adjusted positions of the back support, and the back supporting link has a lower end comprising a formation for releasable engagement with any selected teeth to hold the back support at a selected orientation relative to the seat pad. The link is releasable from the retaining formations to allow both the back support and supporting link to be folded flat against the support base in the folded, storage position.

A first locking device may be provided for releasably locking the front leg to the support base in the folded position. A second locking device may be provided for releasably locking the supporting link to the support base in the folded position. In an exemplary embodiment, the rear face of the back support, the supporting link, and the retaining formations on the support base are designed to nest together in the folded position for more compact storage. The rear face of the back support may have a pair of projecting rails or runners between which the supporting link and retaining formations are nested in the folded position, and the supporting link may have spaced, parallel side walls between which the retaining formations engage. This nesting arrangement has the advantage of allowing a flatter storage condition and also avoids or reduces the risk of any damage to the underside of the upholstered back pad.

According to another aspect of the present invention, an adjustable foldable bench is provided which comprises an elongate base having a rear end for engaging the ground and a forward end, a front leg secured to the base adjacent the forward end for supporting the forward end of the base in a raised position, a back support pivotally mounted on the support base at a location between the ends for movement between a folded position flat against the support base and a plurality of adjusted, inclined positions relative to the support base, a support link having a first end pivoted to a rear face of the back support and a second end, the support base having a raised rack-out comprising a series of spaced retaining formations for releasably engaging the second end of the support link to hold the back support at a series of selected orientations relative to the support base, the support link being foldable flat against the support base with the back support in the folded position, and a releasable locking device for releasably locking the support link to the raised rack-out in the folded position.

The arrangement of locking the support link directly to the raised rack-out on the support base avoids the need for providing any separate brackets or the like for engagement with the locking device or lock pin, reducing the number of parts and making the assembly more compact. The retaining formations may comprise a series of spaced, upwardly projecting teeth which may have a curved front side for retaining the end of the support link when engaged with respective teeth and an angled back side. One tooth may have an opening for receiving a lock pin extending from an aligned position on the support link when the support link is in the folded position.

In an exemplary embodiment of the invention, the rear face of the back support has a pair of spaced, parallel L-shaped runners or brackets between which the support link is nested in the folded position, and the retaining formations on the support base comprise first and second sets of spaced, upwardly projecting teeth, each tooth in a respective set aligned with a corresponding tooth in the other set. The support link is of generally U-shaped cross-section and has spaced longitudinal sides which are at a spacing greater than the spacing between the two sets of teeth, so that the support link is nested over at least some of the teeth in the folded position, while the runners on the back support nest over both the support link and the two sets of teeth. This provides a very compact, flat folded condition for the bench, so that it may be stored in a relatively narrow storage space such as under a bed or in a closet.

A carrying handle may be provided on one side of the back rest. This allows the bench to be easily transported when in the folded, locked condition.

The foldable, adjustable exercise bench of this invention is easy to use and is easy and inexpensive to manufacture. It has a simple, strong, and safe design, and can be folded flat into a very compact state. It is generally easier to carry than most prior art exercise benches, due to its compactness when folded flat, as well as the convenient, integral carrying handle. Once the front leg is deployed and the back rest is raised, it is quite easy to adjust the orientation of the back rest in order to perform decline, flat, incline and shoulder press exercises.

BRIEF DESCRIPTION OF THE DRAWINGS

The present invention will be better understood from the following detailed description of an exemplary embodiment of the invention, taken in conjunction with the accompanying drawings in which like reference numerals refer to like parts and in which.

DETAILED DESCRIPTION OF THE DRAWINGS

Figure 14:
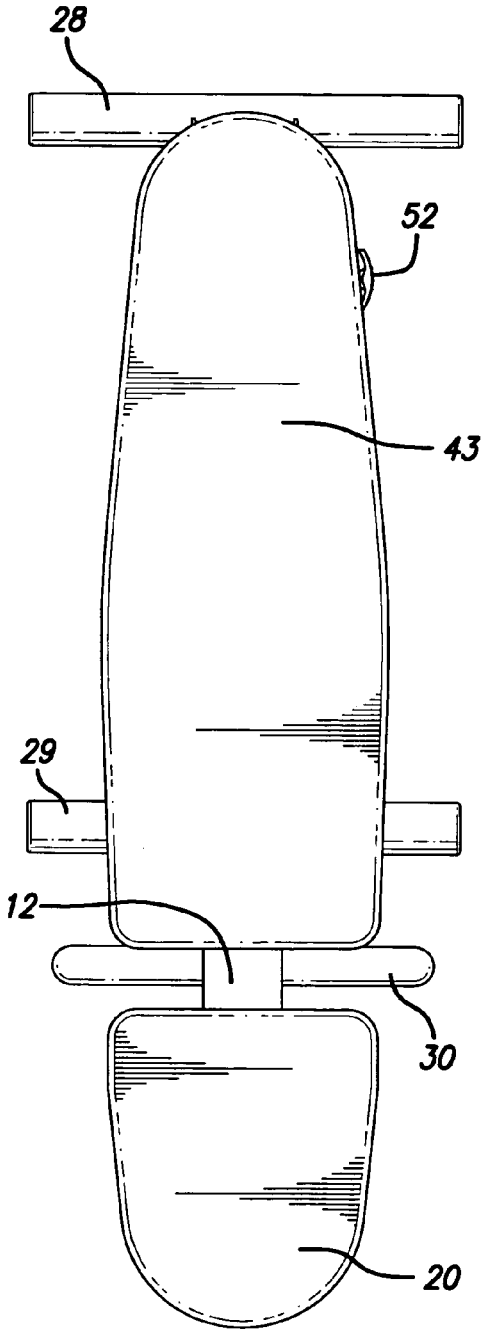
FIG. 14 is a top plan view of the exercise bench in the fully folded, storage position.
Figure 15:
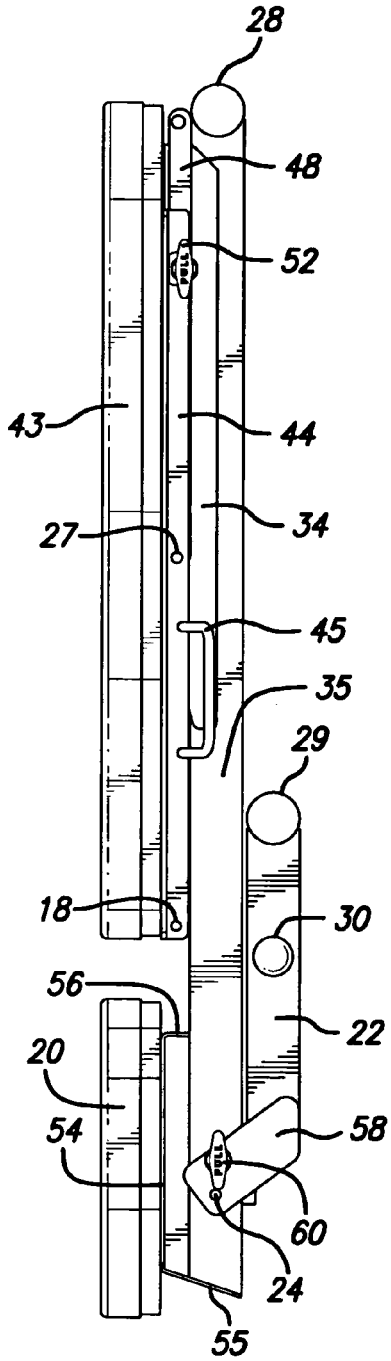
FIG. 15 is a side elevation view of the exercise bench in the position of FIG. 14.
Figure 16:
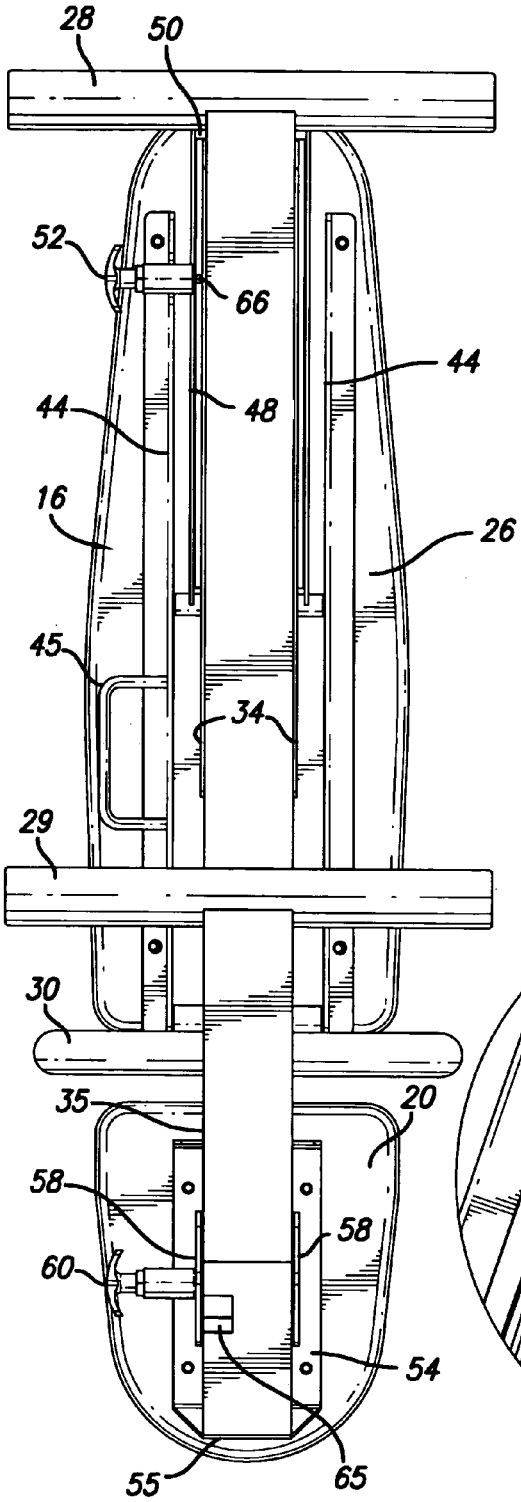
FIG. 16 is a bottom plan view of the exercise bench in the position of FIGS. 14 and 15.

FIGS. 1 to 16 illustrate a foldable exercise bench 10 according to an exemplary embodiment of the present invention. The exercise bench is a so-called FID or flat-incline-decline bench which is adjustable between various different back rest orientations for performing different types of exercise. It is also collapsible into a relatively flat, fully folded condition as illustrated in FIGS. 14 to 16 for storage or transportation purposes.

The bench 10 basically comprises an elongate support base or strut 12 having a rear end 14 for engaging the ground and a forward end 15, a back rest 16 having a first end pivoted to the support base at pivot 18 at a location between the ends of the support base, a seat pad 20 mounted on the support base in front of the back rest 16 for forming a seat, and a front leg 22 pivoted at one end to the support base at a location adjacent its forward end, via pivot 24. A support link or lever 25 is pivoted at one end to the back rest via pivot 27, and engages the support base at its lower end to hold the back rest at a selected orientation, as described in more detail below.

The support base or strut 12 is a single elongate metal rod or tube with a cross member 28 attached to its rear end to act as a rear support foot. The front leg 22 is a similar bar or strut with a cross member 29 at its lower end acting as the front support foot, giving the front leg a general T-shape. A foot rest bar 30 is mounted to extend transverse to the front leg at a location spaced above the front support foot 29, with opposite portions of the foot rest bar projecting from opposite side faces 32 of the front leg.

Figure 2:
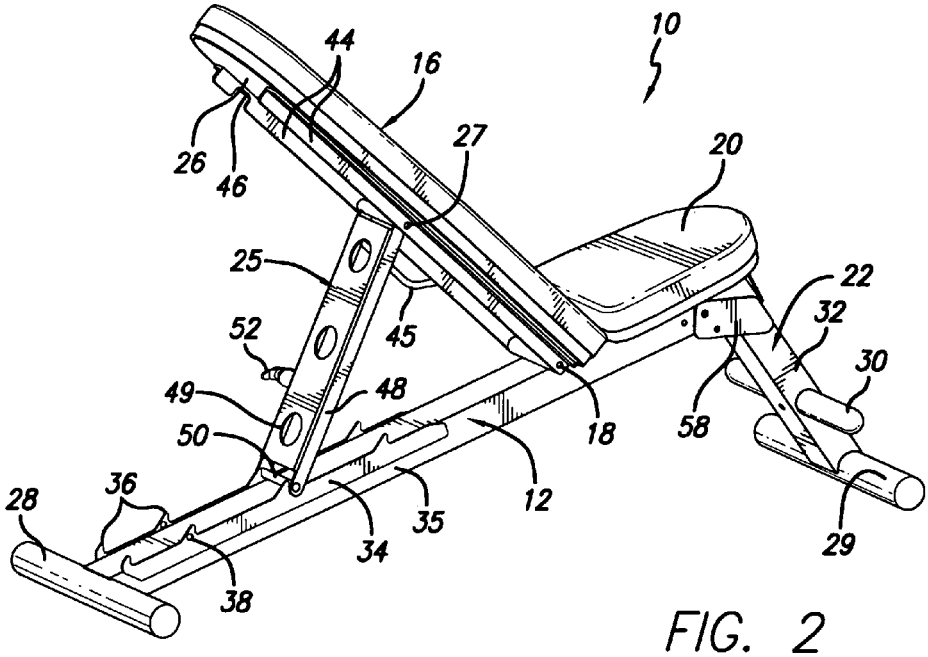
FIG. 2 is a rear perspective view of the bench in the position of FIG. 1.
Figure 9:
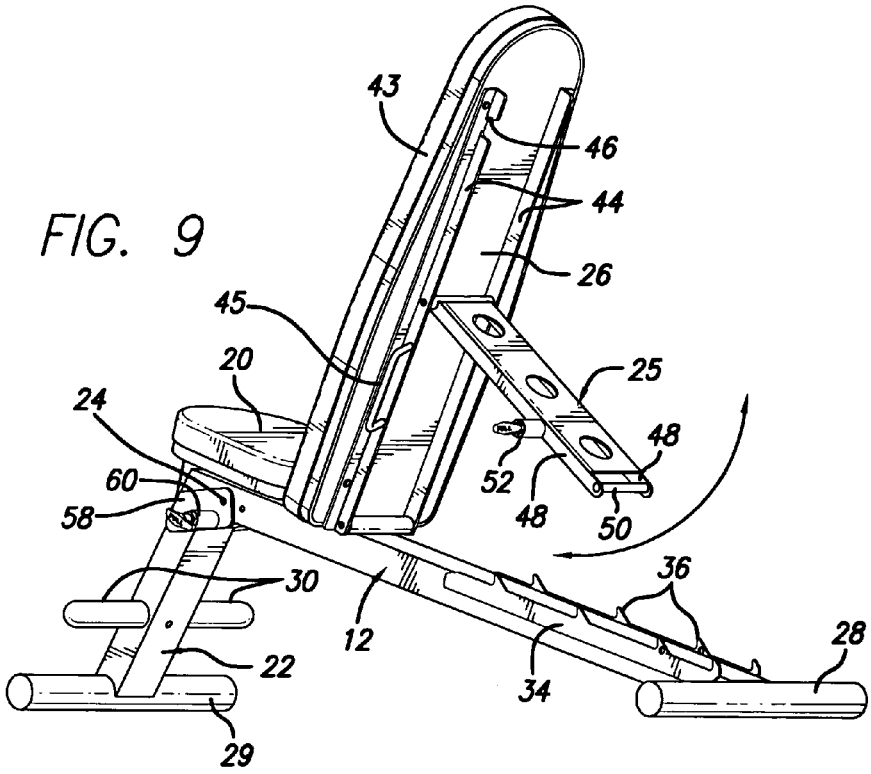
FIG. 9 is a rear perspective view of the exercise bench showing the back pad support link in a released position to illustrate the free swinging ability of the support link.

A retaining or locking rack is mounted on the support base. The retaining rack comprises a pair of identical, elongate plates 34 which are secured to opposite side faces 35 of the support base or strut 12 at a location spaced rearwardly from the back pad. The plates 34 extend up to a location close to the rear support foot 28. Each plate 34 has a series of spaced, upwardly projecting teeth 36, with each tooth on one plate aligned with a respective tooth on the other plate, as best illustrated in FIGS. 2 and 9. The upper straight edges of the plates project up above the top face of the support base 12, along with the teeth 36. The two plates together form a retaining or locking rack for the support link 25.

Figure 10:
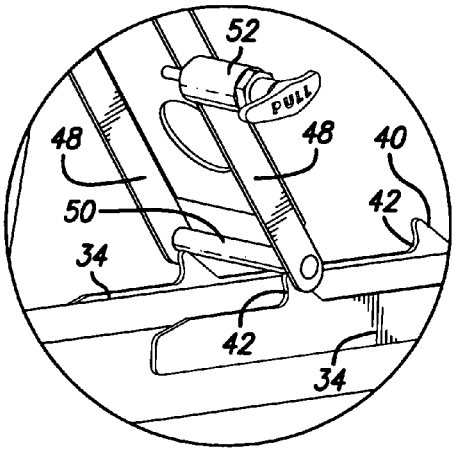
FIG. 10 is an enlarged view of part of the exercise bench illustrating the ramping of the lower end of the support link over the teeth on the retaining rack.
Figure 11:
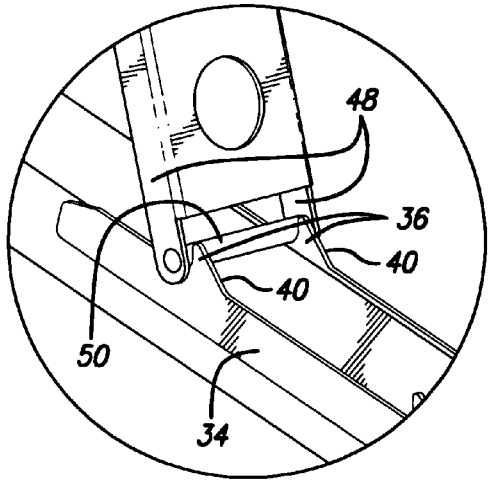
FIG. 11 is an enlarged view similar to FIG. 10 illustrating the locking position of the support link in front of one pair of retaining or locking teeth.
Figure 12:
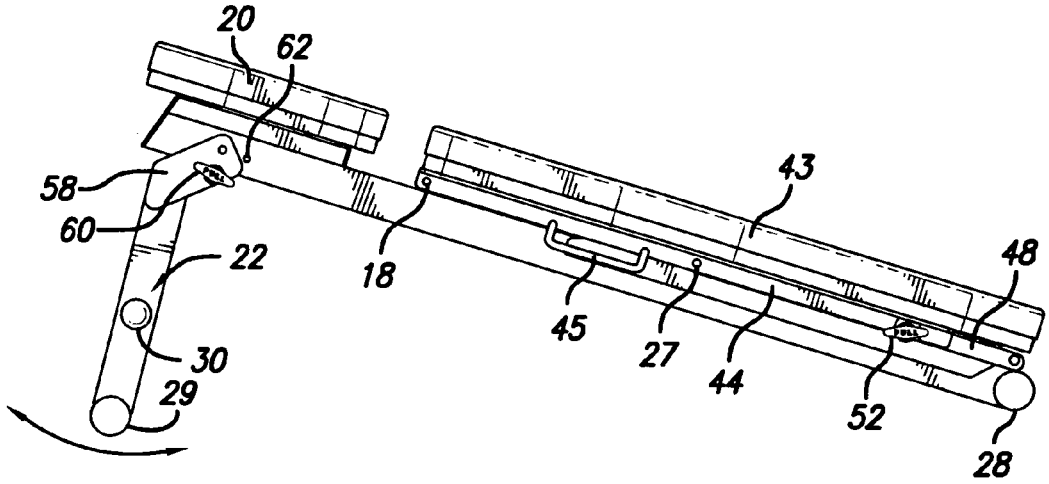
FIG. 12 is a side elevation view of the exercise bench similar to that of FIG. 8 but illustrating rearward pivoting motion of the front leg.

In the illustrated embodiment, a series of four spaced teeth 36 are provided, but a greater or lesser number may be provided if desired, dependent on the number of different back rest orientations required. A pinning hole 38 is located in one of the teeth 36 at a location below the top edge of the tooth and above the top face of the support base. Each tooth has an angled back side 40 and a curved front side 42, as best illustrated in FIGS. 10 and 11.

Figure 1:
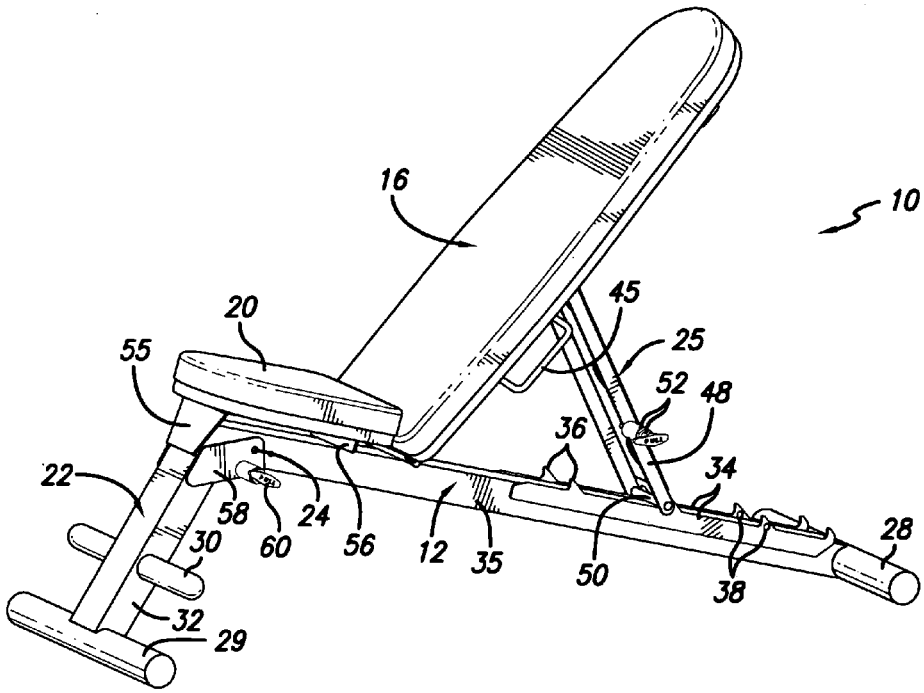
FIG. 1 is a front perspective view of an exercise bench according to an exemplary embodiment of the invention in a selected exercise position.
Figure 3:
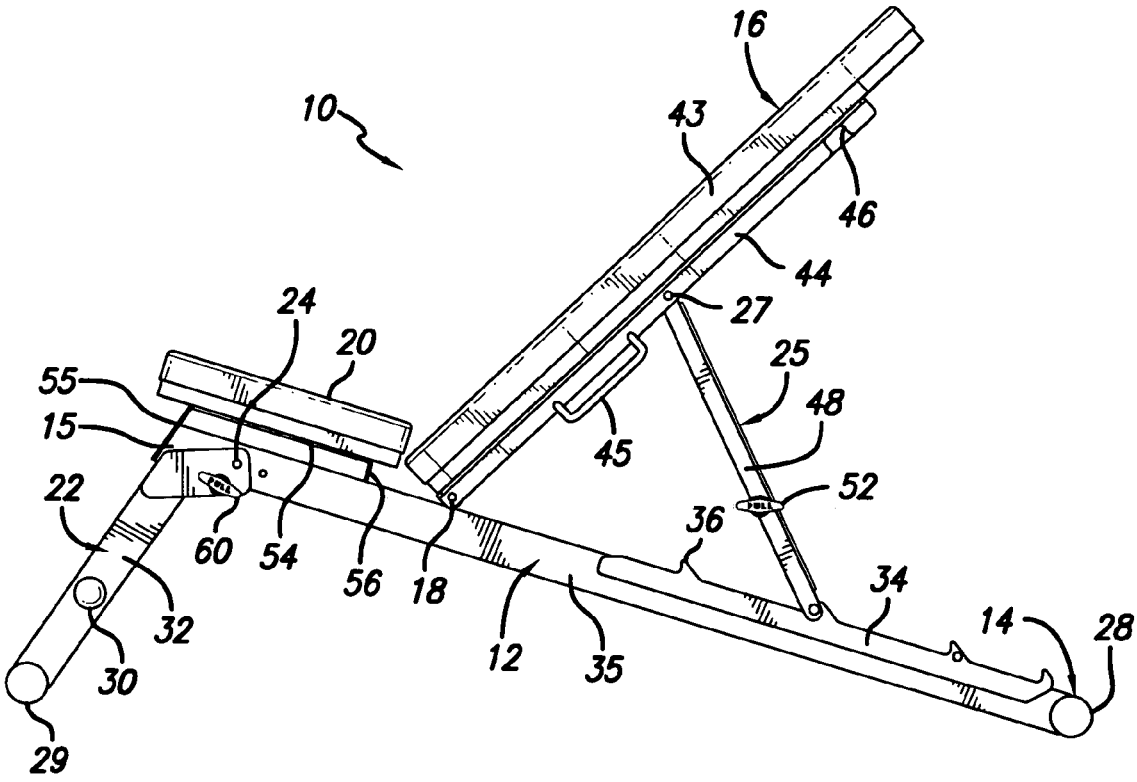
FIG. 3 is a side elevation view of the exercise bench in the inclined position of FIGS. 1 and 2.
Figure 4:
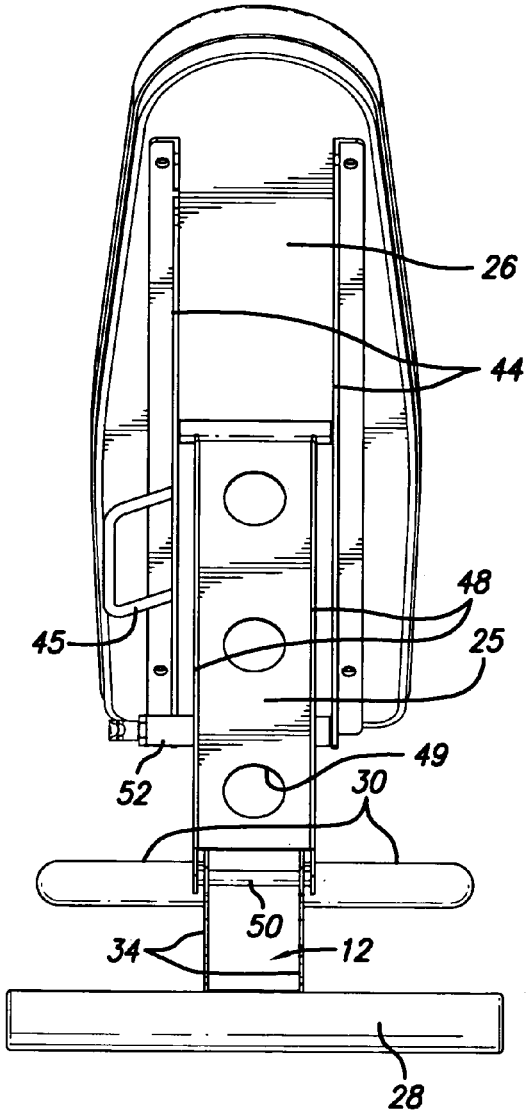
FIG. 4 is a rear elevation view of the exercise bench in the position of FIGS. 1 to 3.

The back rest 16 comprises a back pad 43 for supporting the back of an exerciser, and a pair of spaced, parallel L-shaped runners or brackets 44 which are attached directly to the rear face 26 of the back pad. A carrying handle 45 is welded to one of the brackets 44 so as to project outwardly to one side of the bracket, as best illustrated in FIGS. 1, 3 and 4. The same bracket 44 also has notch 46 adjacent its upper end, as illustrated in FIGS. 2, 9, 16 and 17.

The support link or lever 25 for the back rest is pivoted at its upper end between the brackets 44 via pivot pin 27, as illustrated in FIG. 2. Link 25 comprises an elongate plate or web having a pair of downwardly directed side rims 48 forming a generally U-shaped cross section, as best illustrated in FIGS. 1, 2 and 10. This one-piece connecting link has greater rigidity than some prior art arrangements and is easy and inexpensive to produce. The plate or web may have a series of holes 49 for reducing weight. A positioning member or pin 50 of circular cross-section is secured between the lower ends of the side rims 48, and is designed to engage the projecting teeth 36 of the retaining rack on the base support, as indicated in the drawings. As illustrated in FIGS. 1, 2 and 11, the round pin 50 is a close fit in the rounded or curved front side 42 of a selected pair of teeth when engaged with the retaining or locking rack.

A spring-loaded pull pin 52 is mounted at an intermediate position on one of the side rims 48 of the support link 25. Pull pin 52 acts as a handle to aid in adjusting the back pad, as well as a locking device for securing the support link in the collapsed or folded condition, as will be described in more detail in connection with FIG. 16.

The seat pad 20 is mounted on the support base or strut 12 via seat mounting bracket 54 which is generally U-shaped, as illustrated in the side view of FIG. 3. Bracket 54 has a flat upper portion or web on which the seat pad 20 is secured, and a front leg 55 which is longer than the rear leg 56 and which is angled slightly outward. The front leg 55 caps off the open front end of the tubular support base or strut 12, as best illustrated in FIGS. 1 and 3, increasing the structural integrity of the front end of the base. The second or rear leg 56 of the seat mounting bracket attaches to the top side of the support base 12, positioning the upper portion or web slightly above the upper face of the support base to allow attachment of the seat pad.

Figure 13:
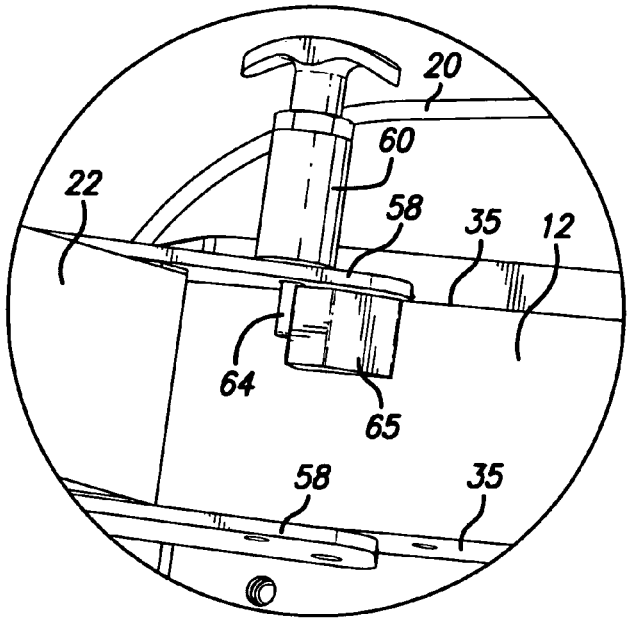
FIG. 13 is a bottom plan view of the front end of the exercise bench illustrating the stop position of the front leg.

The front leg 22 of the exercise bench has a pair of mounting plates 58 welded to its opposite side faces 32 adjacent its upper end so as to project rearwardly at an angle to the front leg and over the opposite side faces 35 of the support base, as best illustrated in FIGS. 2, 3, 13 and 16. A pair of holes are provided in each side face 35 of the support base beneath the seat pad and adjacent the front end of the support base, and corresponding holes are provided in each mounting plate 58. One of the holes in the mounting plate 58 and the corresponding hole in the side face of the support base are for receiving pivot pin 24 for the front leg 22. A pull pin 60 is attached to one of the mounting plates 58 over the second hole in that plate, as illustrated in FIGS. 1, 3 and 13. The second hole 62 in the side face 35 of the support base comprises a pinning hole and is positioned to receive the spring-loaded plunger 64 of the pull pin 60 when the front leg is in the folded, storage position, as will be described in more detail below. When the front leg is in the exercise or deployed position of FIGS. 1 to 3, the plunger 64 will extend beneath the support base 12 as illustrated in FIG. 13, and will engage a stop member 65 located on the underside of the support base to lock the front leg in the exercise or support position.

Figure 5:
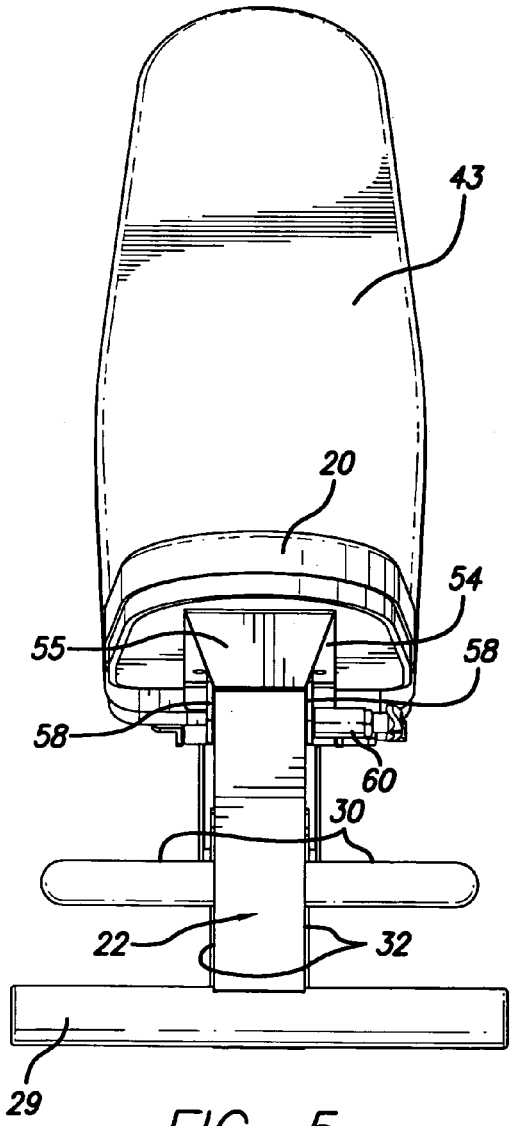
FIG. 5 is a front elevation view of the exercise bench in the position of FIGS. 1 to 4.

In the exercise position, the front leg 22 is designed to wedge up against the underside of the support base 12 for support, as illustrated in FIGS. 5 and 13. The capped forward end 15 of the support base provides added strength and helps to prevent the tubular strut forming the support base from collapsing. In each of the various possible exercise positions of the bench, the foot rest bar 30 can be used as a foot rest by placing the feet on top of the bar, or as an anchor to hold the user in place by hooking the feet under the bar. The foot rest bar is narrower in width than the side faces 32 of the front leg, so that it does not protrude outwardly beyond the front or rear face of the front leg.

FIGS. 1 to 5 of the drawings illustrate one of four possible exercise positions of the exercise bench, in which the positioning pin 50 at the lower end of the support link 25 is engaged in front of the second teeth 36 of the retaining or locking rack. In this position, the back rest 16 is in an intermediate, rearwardly inclined orientation for use in performing various types of upper and lower body exercises.

If the user wishes to raise the back rest, they pivot the back rest up and the self-ramping feature of the connecting link and teeth of the receiving rack allow pin 50 to ramp up and over the teeth into a new selected bracket position. If the exerciser wishes to lower the back rest of the bench, they simply have to disengage the positioning pin 50 from the teeth 36, using the pull pin 52 as a handle. At this point, the support link 25 is free swinging about pivot 27, and can be moved to engage any selected pair of teeth 36. As indicated in FIG. 10, the positioning pin 50 engages and ramps over the angled rear face of the selected teeth, and then locks into the curved front faces of the selected teeth as indicated in FIG. 11. The raised straight edges of the plates 34 prevent the positioning pin 50 from dragging across the top face of the support base as the support link is adjusted from one position to another. Instead, the pin 50 will drag across the upper edges of the plates 34, avoiding marring of the painted top surface of the support base. The angled back edges 40 of the locking teeth 36 allow the positioning pin or rod to ramp up easily over the tooth to automatically find the next adjustment position.

Figure 6:
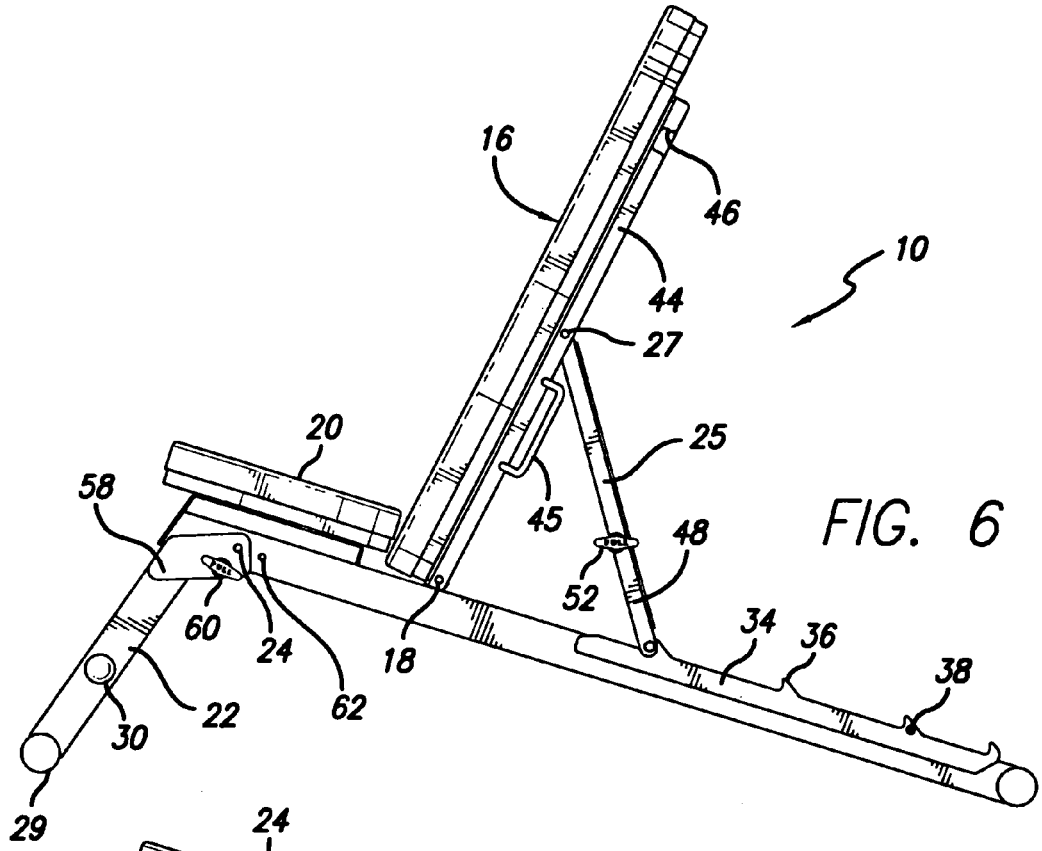
FIG. 6 is a side elevation view illustrating the exercise bench in a first exercise position with the back pad in a full upright position.
Figure 7:
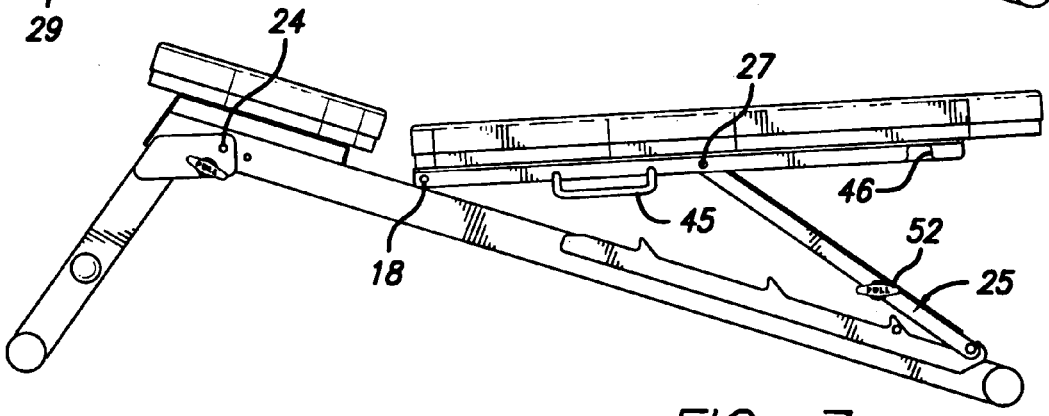
FIG. 7 is a side elevation view illustrating the exercise bench in one of two intermediate exercise positions.
Figure 8:
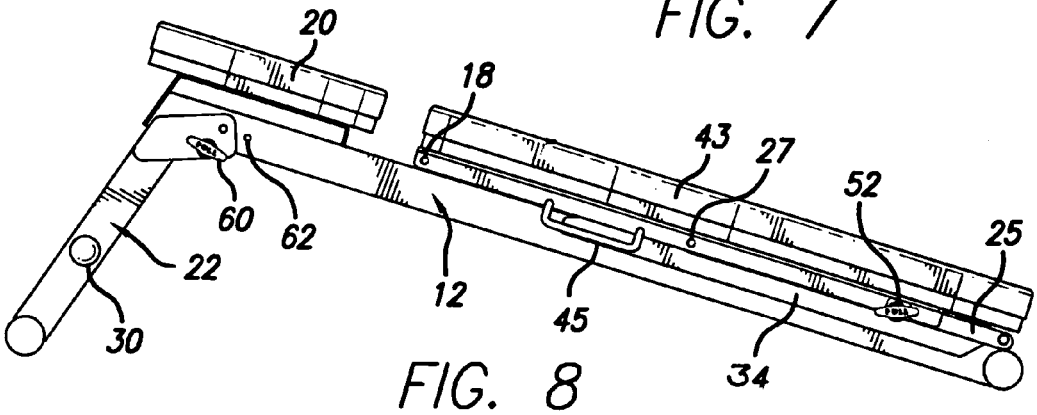
FIG. 8 is a side elevation view illustrating the exercise bench in another exercise position in which the back pad is in a full recline position.

FIGS. 6 to 8 illustrate three other possible exercise positions of the bench 10. FIG. 6 illustrates the positioning pin 50 engaging the front pair of teeth 36 to place the back pad in the full upright position, which would be selected when performing shoulder press or biceps curl exercises. FIG. 7 illustrates the positioning pin engaging the rear pair of teeth 36 and the back pad in a more rearwardly inclined orientation for performing various upper and lower body exercises. Another possible rearwardly inclined orientation (not illustrated) is provided by engaging pin 50 in the third set of teeth.

Figure 17:
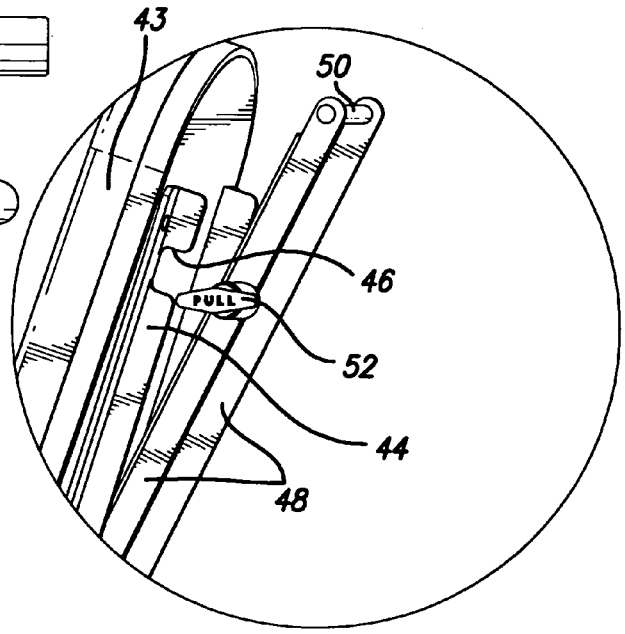
FIG. 17 is a side view of part of the back pad and support link illustrating their positions immediately prior to folding into the flat or storage position.

FIG. 8 illustrates the back pad in the full recline position which would be selected for performing decline press or abdominal crunch exercises. In order to place the back pad in this position, the positioning pin 50 is released from the retaining or locking teeth and is then swung outwardly beyond the rear ends of the retaining plates 34, while the back pad is folded downwardly about pivot 18 until it rests on top of the support base. At this point, the pull pin 52 will engage in the notch 46 in one runner or bracket 44 of the back support, as indicated in FIGS. 8 and 17, and the support link 25 will be nested between the brackets 44, while the opposite side rims of the support link will nest over the raised teeth 36 of the plates 35. In this position, the pull pin 52 is aligned with the hole 38 in the respective third tooth 36, and can be retracted and released to extend through the hole and lock the support link to the support base.

The foldable bench therefore has five different possible exercise positions with the back pad at various orientations. It will be understood that a greater number of different positions may be provided if desired, simply by providing additional pairs of teeth on the respective plates 34. Similarly, a reduced number of teeth may be provided if a lesser number of exercise positions are required.

FIGS. 14 to 16 illustrate the bench 10 in the folded, storage position. In order to collapse the bench into a storage position, the user first collapses the back pad in the manner described above in connection with FIG. 8. The user lifts the support link, using the pull pin 52 as a handle, so that it is released from the retaining teeth 36, as indicated in FIG. 9. The back pad is then folded all the way down, together with the support link, and the extending plunger 66 of the pull pin is engaged in the pinning hole 38 in the aligned tooth 36. The pull pin housing engages in the notch 46 in one of the runners or brackets 44 at the rear of the back pad, with FIG. 17 illustrating the movement of the notch 46 over the pull pin 52 as the parts are collapsed and folded together.

The user next disengages the pull pin 60 on the front leg from the stop member 65, allowing the front leg 22 to be folded rearward about pivot 24 into the storage position of FIG. 15. At this point, the pull pin 60 is aligned with the pinning hole 62 on the adjacent side face 35 of the base support, and the plunger 64 is released to extend through the aligned hole in plate 58 and the hole 62 to lock the leg in the storage position. When the leg 22 is folded, it provides a flat, resting surface because nothing protrudes beyond the flat front face (or lower face when the leg is folded as in FIG. 15).

The folded, storage position of the exercise bench 10 has a very compact, thin profile due to the compact design of the front leg 22 with no protruding parts, as well as the nested foldable arrangement of the back pad, support link, and retaining teeth. The association between the adjustable back support, support link, and support base is such that, when folded into the storage position, the upwardly projecting teeth 36 on the plates 34 fit between the downwardly directed side rims 48 of the support link, and the support link fits in between the two runners 44 of the back support, as best illustrated in FIG. 16, with the pull pin 52 fitting into the notch 46 in the adjacent runner 44. This nesting ability allows the back pad to fold up as tight as possible against the base support. It also protects the upholstery of the back pad, since the projecting teeth fit inside the U-shaped support link, while the flat face of the support link rests against the rear surface of the back pad and protects it from damage. This arrangement not only protects the upholstery, but also prevents damage to the teeth.

The thin profile storage position of the bench allows it to easily fit in a relatively small storage space such as under a bed or in a closet. The integral handle 45 and flat storage position allow the folded bench to be carried relatively easily.

Figure 18:
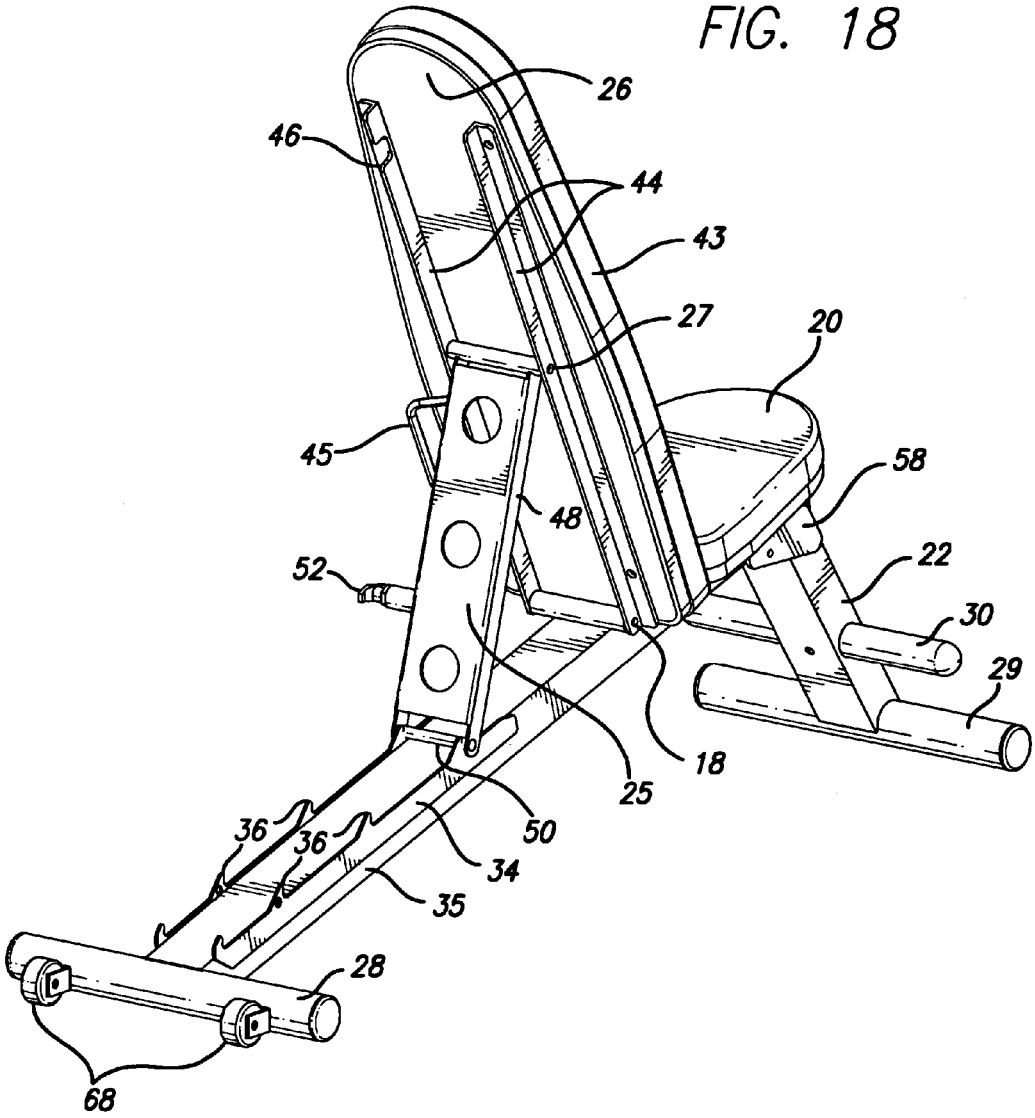
FIG. 18 is a rear elevation view of a modified exercise bench in the full upright position.

FIG. 18 illustrates a modification of the exercise bench 10 to provide wheels 68 on the rear foot 28 of the support base 12. The exercise bench is otherwise identical to the previous embodiment, and like reference numerals have been used for like parts as appropriate. Wheels 68 aid in positioning the bench in an exercise environment.

The foldable exercise bench of this invention is easy to manufacture, with a reduced number of parts, and is also easy to use, and compact. It is a simple, strong, inexpensive and reliable design. The folded bench is relatively flat and compact, and is easy to carry from place to place due to the integral handle. In the upright position, the back pad orientation can be adjusted quickly and easily, and with little effort.

The nesting arrangement between the back pad, support link, and upper edges and teeth of the retaining plates or racks is compact and protects both the teeth and the rear face of the back pad upholstery from damage. The support link adjusts and locks in the same raised rack-out or teeth, and also locks to one of the teeth in the folded condition, reducing the number of parts. The positioning pin or rod is locked in the curved front edge of the respective tooth in the exercise positions, and no secondary pinning device is required for this purpose, further reducing the number of parts.

Although an exemplary embodiment of the invention has been described above by way of example only, it will be understood by those skilled in the field that modifications may be made to the disclosed embodiment without departing from the scope of the invention, which is defined by the appended claims.

I claim:

1. An adjustable foldable bench, comprising:

an elongate support base having a rear end for engaging the ground and a forward end;

a front leg secured to the base adjacent the forward end for supporting the forward end of the base in a raised position;

a back support pivotally mounted on the support base at a location between the ends of the base for movement between a folded position flat against the support base and a plurality of adjusted, inclined positions relative to the support base;

a support link having a first end pivoted to the back support and a second end;

the support base having a raised rack-out comprising a series of spaced retaining formations for releasably engaging the second end of the support link to hold the back support at a series of selected orientations relative to the support base, the support link being foldable flat against the support base together with the back support in the folded position;

a releasable locking device which locks the support link to the raised rack-out in one position only of the back support, the one position comprising the folded position; and a pair of parallel, spaced projecting runners on the rear face of the back support, the runners being at a predetermined spacing greater than the width of the support link, whereby the support link is nested between the runners in the folded position.

2. An adjustable foldable bench, comprising:

an elongate support base having a rear end for engaging the ground and a forward end;

a front leg secured to the base adjacent the forward end for supporting the forward end of the base in a raised position;

a back support pivotally mounted on the support base at a location between the ends of the base for movement between a folded position flat against the support base and a plurality of adjusted, inclined positions relative to the support base;

a support link having a first end pivoted to the back support and a second end;

the support base having a raised rack-out comprising a series of spaced retaining formations for releasably engaging the second end of the support link to hold the back support at a series of selected orientations relative to the support base, the support link being foldable flat against the support base together with the back support in the folded position;

a releasable locking device for releasably locking the support link to the raised rack-out in the folded position;

the raised rack-out comprising spaced first and second plates each having an upper edge and a plurality of spaced teeth projecting upwardly from the upper edge of each plate, each tooth on one plate being aligned with a respective tooth on the other plate; and the support link comprising a flat web of predetermined width having opposite, downwardly directed side rims, and the plates being at a predetermined spacing less than the width of the web, whereby at least the upper edges and teeth of the plates are nested between the side rims of the support link in the folded position.

3. The bench as claimed in claim 2, wherein the support base has a flat top surface and opposite sides, the first plate being secured to one side of the support base and the second plate being secured to the other side of the support base, the upper edge and teeth of each plate being spaced above the top surface of the support base.

4. The bench as claimed in claim 2, wherein one tooth of a respective plate has a pinning hole, and a pull pin is mounted at a predetermined position on the corresponding side rim of the support link for alignment with the pinning hole in the folded position, the pull pin and pinning hole comprising said releasable locking device.

5. The bench as claimed in claim 2, further comprising a pair of spaced, parallel runners on the rear face of the back support, the runners being at a predetermined spacing greater than the width of the support link web, whereby the support link and upper edges and teeth of the plates are nested between said runners in the folded position.

6. The bench as claimed in claim 5, wherein one of said runners has a notch for engaging over said locking device in the folded position.

7. The bench as claimed in claim 5, further comprising a handle secured to one of said runners and projecting out to one side of the back support for use in carrying the bench when in the folded position.

8. An adjustable foldable bench, comprising:

an elongate support base having a rear end for engaging the ground and a forward end;

a front leg secured to the base adjacent the forward end for supporting the forward end of the base in a raised position;

a back support pivotally mounted on the support base at a location between the ends of the base for movement between a folded position flat against the support base and a plurality of adjusted, inclined positions relative to the support base;

a support link having a first end pivoted to the back support and a second end;

the support base having a raised rack-out comprising a series of spaced retaining formations for releasably engaging the second end of the support link to hold the back support at a series of selected orientations relative to the support base, the support link being foldable flat against the support base together with the back support in the folded position;

a releasable locking device for releasably locking the support link to the raised rack-out in the folded position; and a seat pad and a mounting bracket securing the seat pad to the support base in front of the back support, the mounting bracket being substantially U-shaped and having a flat web secured to the seat pad with a front end adjacent the front end of the seat pad and a rear end, a first leg projecting downwardly from the front end of the web and a second leg projecting downwardly from the rear end of the web, the legs being secured to the support base.

9. The bench as claimed in claim 8, further comprising a foot rest secured to the front leg at a location between the first and second ends, the front leg having a front face and opposite side faces, the side faces being of predetermined width, and the foot rest comprising first and second foot rest portions projecting from the opposite side faces for engagement by a user's right and left feet, the width of the foot rest being no greater than the width of the side faces, whereby the foot rest does not project outwardly beyond the front face of the front leg in either the deployed or folded position.

10. The bench as claimed in claim 8, wherein the support base comprises a tubular member having an open forward end, the first leg of the mounting bracket being longer than the second leg and extending downwardly over the open forward end of the tubular member to form an end cap.

11. A foldable exercise bench, comprising:

a support base having a rear end for engaging the ground and a forward end;

a back support pivotally mounted on the support base at a location between the ends for movement between a folded position flat against the support base and a plurality of adjusted, inclined positions relative to the support base;

a seat on the support base in front of the back support; and a front support leg having a first end pivotally secured to the support base and a second end for engaging the ground in a deployed position to support the forward end of the support base in a position raised above the ground, the front support leg being movable between a deployed position engaging the ground and a folded position folded flat against the support base; the front support leg having a front face and a rear face;

an integrated foot rest on the support leg located in line with the support leg and not protruding forwardly or rearwardly from the front or rear face of the support leg; and a support link having a first end pivoted to a rear face of the back support and a second end, the support base having a raised rack-out comprising a series of spaced retaining formations for releasably engaging the second end of the support link to hold the back support at a series of selected orientations relative to the support base, the support link being foldable flat against the support base together with the back support in the folded position, and a releasable locking device for releasably locking the support link to the raised rack-out in the folded position.

12. The bench as claimed in claim 11, wherein the retaining formations comprise teeth, one of the teeth having a pinning hole, the locking device comprising a pull pin on the support link for alignment with the pinning hole in the folded position, the pull pin having a plunger for engaging through the pinning hole to lock the support link in the folded position.

13. A foldable exercise bench, comprising:

a support base having a rear end for engaging the ground and a forward end;

a back support pivotally mounted on the support base at a location between the ends for movement between a folded position flat against the support base and a plurality of adjusted, inclined positions relative to the support base;

a seat on the support base in front of the back support; and a front support leg having a first end pivotally secured to the support base and a second end for engaging the ground in a deployed position to support the forward end of the support base in a position raised above the ground, the front support leg being movable between a deployed position engaging the ground and a folded position folded flat against the support base; the front support leg having a front face and a rear face;

an integrated foot rest on the support leg located in line with the support leg and not protruding forwardly or rearwardly from the front or rear face of the support leg; and a locking device for releasably locking the leg to the support base in the folded position.

14. The bench as claimed in claim 13, including a carrying handle for transporting the bench in the folded position.

15. The bench as claimed in claim 13, wherein the locking device comprises a spring loaded plunger mounted on the leg, the support base having a pinning hole for receiving the plunger in the folded position of the leg.

16. The bench as claimed in claim 15, further comprising a stop member on the support base for engaging the plunger in the deployed position of the front support leg to hold the front leg in the deployed position.

17. A foldable exercise bench, comprising:

a support base having a rear end for engaging the ground and a forward end;

a back support pivotally mounted on the support base at a location between the ends for movement between a folded position flat against the support base and a plurality of adjusted, inclined positions relative to the support base;

a seat on the support base in front of the back support;

a front support leg having a first end pivotally secured to the support base and a second end for engaging the ground in a deployed position to support the forward end of the support base in a position raised above the ground, the front support leg being movable between a deployed position engaging the ground and a folded position folded flat against the support base: the front support leg having a front face and a rear face;

an integrated foot rest on the support leg located in line with the support leg and not protruding forwardly or rearwardly from the front or rear face of the support leg; and a mounting bracket securing the seat to the support base in front of the back support, the seat comprising a pad, the mounting bracket being substantially U-shaped and having a flat web secured to a lower surface of the seat pad with a front end adjacent the front end of the seat pad and a rear end, a first leg projecting downwardly from the front end of the web and a second leg projecting downwardly from the rear end of the web, the legs being secured to the support base.

18. The bench as claimed in claim 17, wherein the support base comprises a tubular member having an open forward end, the first leg of the mounting bracket being longer than the second leg and extending downwardly over the open forward end of the tubular member to form an end cap.

19. The bench as claimed in claim 17, wherein the seat pad is spaced above the support base by the legs of the mounting bracket.

20. A foldable exercise bench, comprising:

a support base having a rear end which engages the ground and a forward end;

a back support pivotally mounted on the support base at a location between the ends which moves between a folded position flat against the support base and a plurality of adjusted, inclined positions relative to the support base;

a seat on the support base in front of the back support;

a front support leg having a first end secured to the support base and a second end which engages the ground in a deployed position to support the forward end of the support base in a position raised above the ground;

a support link having a first end pivoted to the back support and a second end;

the support base having a raised rack-out comprising a series of spaced retaining formations which releasably engage the second end of the support link to hold the back support at a series of selected orientations relative to the support base, the support link being foldable flat against the support base together with the back support in the folded position;

the support link having a generally U-shaped cross-section and comprising a flat web and spaced side rims, the side rims being at a predetermined spacing for nesting over the raised rack-out in the folded position with the flat web between the raised rack-out and the rear face of the back support; and a pair of spaced, parallel runners projecting outwardly from the rear face of the back pad, the spacing between the runners being greater than the spacing between the side rims of the support link, whereby the support link is nested between the runners in the folded position.

21. The bench as claimed in claim 20, wherein the raised rack-out has a pinning hole and a locking device is mounted on one side rim of the support link for engaging the pinning hole in the folded position.

22. The bench as claimed in claim 21, wherein the raised rack-out comprises a plurality of spaced teeth and the pinning hole is located in one of the teeth.

23. The bench as claimed in claim 21, wherein one of said runners has a notch for engaging over said locking device in the folded, nested position.

24. A foldable exercise bench, comprising:

a support base having a rear end which engages the ground and a forward end;

a back support pivotally mounted on the support base at a location between the ends which moves between a folded position flat against the support base and a plurality of adjusted, inclined positions relative to the support base;

a seat on the support base in front of the back support;

a front support leg having a first end secured to the support base and a second end which engages the ground in a deployed position to support the forward end of the support base in a position raised above the ground;

a support link having a first end pivoted to the back support and a second end;

the support base having a raised rack-out comprising a series of spaced retaining formations which releasably engage the second end of the support link to hold the back support at a series of selected orientations relative to the support base, the support link being foldable flat against the support base together with the back support in the folded position;

the support link having a generally U-shaped cross-section and comprising a flat web and spaced side rims, the side rims being at a predetermined spacing for nesting over the raised rack-out in the folded position with the flat web between the raised rack-out and the rear face of the back support; and the raised rack-out having an upper edge spaced above the upper face of the support base and a plurality of teeth projecting upwardly from said upper edge and comprising said retaining formations.

25. A foldable exercise bench, comprising:

a support base having a rear end for engaging the ground and a forward end;

a back support pivotally mounted on the support base at a location between the ends for movement between a folded position flat against the support base and a plurality of adjusted, inclined positions relative to the support base;

a seat on the support base in front of the back support;

a front support leg having a first end secured to the support base and a second end for engaging the ground in a deployed position to support the forward end of the support base in a position raised above the ground;

a support link having a first end pivoted to the back support and a second end;

the support base having a raised rack-out comprising a series of spaced retaining formations for releasably engaging the second end of the support link to hold the back support at a series of selected orientations relative to the support base, the support link being foldable flat against the support base together with the back support in the folded position;

the rear face of the back support having a first nesting formation for nesting over the support link in the folded position and the support link having a second nesting formation for nesting over the raised rack-out in the folded position, whereby both the raised rack-out and the support link are nested within the first nesting formation in the folded position; and the first nesting formation comprising a pair of spaced parallel brackets on the rear face of the back support.

26. A foldable exercise bench, comprising:

a support base having a rear end for engaging the ground and a forward end;

a back support pivotally mounted on the support base at a location between the ends for movement between a folded position flat against the support base and a plurality of adjusted, inclined positions relative to the support base;

a seat on the support base in front of the back support;

a front support leg having a first end secured to the support base and a second end for engaging the ground in a deployed position to support the forward end of the support base in a position raised above the ground;

a support link having a first end pivoted to the back support and a second end;

the support base having a raised rack-out comprising a series of spaced retaining formations for releasably engaging the second end of the support link to hold the back support at a series of selected orientations relative to the support base, the support link being foldable flat against the support base together with the back support in the folded position;

the rear face of the back support having a first nesting formation for nesting over the support link in the folded position and the support link having a second nesting formation for nesting over the raised rack-out in the folded position, whereby both the raised rack-out and the support link are nested within the first nesting formation in the folded position; and the second nesting formation comprising a pair of downwardly directed opposite side rims on the support link.

27. The bench as claimed in claim 26, further comprising a locking device for locking one side rim of the support link to the raised rack-out in the folded position.

28. The bench as claimed in claim 27, wherein the first nesting formation has a notch for engaging over the locking device in the folded position.

29. The bench as claimed in claim 26, wherein the support link has a flat upper web for extending over the raised rack-out in the folded position to prevent contact between the raised rack-out and rear face of the back pad.

30. A foldable exercise bench, comprising:

a support base having a rear end for engaging the ground and a forward end;

a back support pivotally mounted on the support base at a location between the ends for movement between a folded position flat against the support base and a plurality of adjusted, inclined positions relative to the support base;

a seat on the support base in front of the back support;

a front support leg having a first end secured to the support base and a second end for engaging the ground in a deployed position to support the forward end of the support base in a position raised above the ground;

a support link having a first end pivoted to the back support and a second end;

the support base having a raised rack-out comprising a series of spaced retaining formations for releasably engaging the second end of the support link to hold the back support at a series of selected orientations relative to the support base, the support link being foldable flat against the support base together with the back support in the folded position;

the rear face of the back support having a first nesting formation for nesting over the support link in the folded position and the support link having a second nesting formation for nesting over the raised rack-out in the folded position, whereby both the raised rack-out and the support link are nested within the first nesting formation in the folded position; and the raised rack-out having an upper edge spaced above the upper face of the support base and a plurality of teeth projecting upwardly from said upper edge and comprising said retaining formations.

31. A foldable exercise bench, comprising:

a support base having a rear end for engaging the ground and a forward end;

a back support pivotally mounted on the support base at a location between the ends for movement between a folded position flat against the support base and a plurality of adjusted, inclined positions relative to the support base;

a seat on the support base in front of the back support;

a front support leg having a first end secured to the support base and a second end for engaging the ground in a deployed position to support the forward end of the support base in a position raised above the ground;

a support link having a first end pivoted to the back support and a second end;

the support base having a raised rack-out comprising a series of spaced retaining formations for releasably engaging the second end of the support link to hold the back support at a series of selected orientations relative to the support base, the support link being foldable flat against the support base together with the back support in the folded position;

the rear face of the back support having a first nesting formation for nesting over the support link in the folded position and the support link having a second nesting formation for nesting over the raised rack-out in the folded position, whereby both the raised rack-out and the support link are nested within the first nesting formation in the folded position; and the front support leg being pivotally secured to the support base for movement between the deployed position engaging the ground and a folded position folded flat against the support base.

32. The bench as claimed in claim 31, further comprising a locking device for locking the support leg to the support base in the folded position.

33. The bench as claimed in claim 31, further including a foot rest on the front support leg spaced above the second end of the front support leg, the front leg having a front face, a rear face and opposite side faces, the foot rest having first and second foot engaging portions projecting outwardly from the opposite side faces of the front leg and not protruding forwardly or rearwardly from the front or rear face in either the deployed or folded position.

34. A foldable exercise bench, comprising:

a support base having a rear end for engaging the ground and a forward end;

a back support pivotally mounted on the support base at a location between the ends for movement between a folded position flat against the support base and a plurality of adjusted, inclined positions relative to the support base;

a seat on the support base in front of the back support;

a front support leg having a first end secured to the support base and a second end for engaging the ground in a deployed position to support the forward end of the support base in a position raised above the ground;

a support link having a first end pivoted to the back support and a second end;

the support base having a raised rack-out comprising a series of spaced retaining formations for releasably engaging the second end of the support link to hold the back support at a series of selected orientations relative to the support base, the support link being foldable flat against the support base together with the back support in the folded position;

the rear face of the back support having a first nesting formation for nesting over the support link in the folded position and the support link having a second nesting formation for nesting over the raised rack-out in the folded position, whereby both the raised rack-out and the support link are nested within the first nesting formation in the folded position; and at least one wheel secured to the rear end of the support base.

* * * * *